US006047512A

United States Patent [19]

Wendt et al.

[11] Patent Number: 6,047,512

[45] Date of Patent: Apr. 11, 2000

[54] DRYWALL SUSPENSION GRID SYSTEM

[75] Inventors: Alan C. Wendt, Barrington; David A. Willey, Oak Park, both of Ill.

[73] Assignee: USG Interiors, Inc., Chicago, Ill.

[21] Appl. No.: 09/176,505

[22] Filed: Oct. 21, 1998

[51] Int. Cl.[7] ..... E04B 2/00

[52] U.S. Cl. ..... 52/506.07; 52/506.06; 52/86; 52/88

[58] Field of Search ..... 52/506.07, 506.06, 52/86, 88

[56] References Cited

U.S. PATENT DOCUMENTS

| | | | |
|---|---|---|---|
| 4,189,888 | 2/1980 | Blitzer, Jr. | 52/484 |
| 4,932,170 | 6/1990 | Spear | 52/28 |

OTHER PUBLICATIONS

Armstrong, Drywall Furring System/Typical Vaulted Ceiling (Jan., 1998) (Four Pages).

USG Interiors, Curvatura Three–Dimensional Ceiling System (1995) (Eight Pages).

Chicago Metallic, Infogram (Jan. 1, 1997) (One Page).

USG Interiors, Curvatura (1996) (One Page).

USG Interiors, Curvatura (1995) (Thirty–nine Pages).

*Primary Examiner*—Christopher T. Kent

*Assistant Examiner*—Nkeisha J. Maddox

*Attorney, Agent, or Firm*—Lee, Mann, Smith, McWilliams, Sweeney & Ohlson

[57] ABSTRACT

A drywall suspension grid system comprising a selection of various sized and specified pre-formed and pre-engineered "T" grid beams and components used to construct a grid having a grid face upon which drywall is mounted, thus creating a suspended drywall ceiling. The suspension grid system can be used to create flat ceilings, curved ceilings, soffits, fascia for floating edge ceilings, utility interfaces, or any combination thereof in a suspended grid drywall ceiling.

25 Claims, 17 Drawing Sheets

DRYWALL SUSPENSION GRID SYSTEM

BACKGROUND OF THE INVENTION

The present invention relates to suspended drywall ceilings constructed from a supporting suspension grid. The suspension grid is typically constructed using suspended "T" grid beams joined together in various configurations. A "T" grid beam is an elongated beam with a flange at the bottom of the beam that provides a grid beam face upon which drywall panels can be mounted. The "T" grid beams are joined together by various styles of clips. Typically, the "T" grid beams are made of extruded aluminum or roll-formed steel, and can be straight or curved. The use of straight and curved grid beams within a suspended grid creates a multi-directional grid face surface upon which drywall can be mounted when formed and shaped to match the multi-directional grid face surface. This allows for the creation of drywall ceilings having vaults and other features having curved portions.

The creation of curved portions and features in prior art suspended grid systems requires many modifications to the grid beams during installation. In order to create a curved grid beam, the web portion of a straight grid beam must be cut or notched at measured intervals in order to allow the installer to bend the beam to the desired curvature. This process typically requires the use of additional clips to reinforce the web portion at each cut or notch. This increases the cost of installation. This process also results in the creation of a faceted grid beam face surface only approximating a curve, due to the bending concentration at the cut or notch and straight portions in between the cuts or notches. This adversely affects how the drywall panels fit upon the grid beam face surface. Furthermore, since the curved grid beams are created at the installation site, there is less consistency in the creation of curved ceiling features from one installation site to the next. Variations in radius, chord length, and arc angle of the curved beam are possible. This customization also requires separate structural evaluation and engineering for each installation site that incorporates such curved features.

It is therefore an object of the present invention to provide a drywall suspension grid system comprising a cataloged selection of standard pre-engineered and pre-formed components so that various curvatures and features of a ceiling may be constructed using these standard components without the need for on-site fabrication.

It is also an object of the present invention to provide a drywall suspension grid system including a selection of standard pre-engineered grid clips that can be used to join the grid beams at various intersection and transition points within the suspension grid, thereby eliminating the need for custom fabricated grid clips for each installation.

It is also an object of the present invention to provide a drywall suspension grid system including pre-engineered and pre-curved grid beams thereby eliminating the need for on-site fabrication and customization of curved grid beams within a drywall suspension grid system.

It is also an object of the present invention to provide a drywall suspension grid system having pre-engineered and pre-formed components, thereby minimizing the need for individual structural evaluation, calculation, and engineering for each separate installation site.

SUMMARY OF THE INVENTION

The invention is a drywall suspension grid system comprising a selection of various sized and specified pre-formed and pre-engineered "T" grid beams and components used to construct a grid having a non faceted grid face surface upon which drywall is mounted, thus creating a suspended drywall ceiling. The suspension grid system can be used to create flat ceilings, curved ceilings, soffits, fascia for floating edge ceilings, utility interfaces, or any combination thereof in a suspended grid drywall ceiling.

The suspension grid system includes straight "T" grid main beams, pre-curved "T" grid main beams, straight "T" grid cross beams, and cross channels. The "T" grid beams are elongated curved or straight beams with a flange at the bottom of the beam that provides a grid beam face. These grid beam faces within the suspended grid collectively create a grid face surface upon which drywall panels can be mounted.

Other components in the system include angle molding, channel molding, and face trim, which are used to create comers and finished edges within the suspended drywall ceiling. Several types of clips are used to join the beams, channels, and trim together to form the suspension grid system. The clips include transition clips, splice clips, splice plates, wall attachment clips, and face trim clips. The transition clips are typically used to join two straight "T" grid beams transverse to each other at their beam ends, but the transition clip is not limited to this type of joint. The transition clip may be used in many situations involving several different "T" grid beam intersection and transition points, thus making this clip very versatile in suspended grid ceiling construction. The transition clip and the various intersection and transition points with which it is utilized is the subject of pending U.S. Patent application Ser. No. 08/991,935, filed on Dec. 16, 1998, herein incorporated by reference.

In certain situations involving transition points between two straight "T" grid main beams or a straight "T" grid main beam and a curved "T" grid main beam, the splice clip is utilized, which allows beams to be joined at such transition points very easily. The splice clip is typically used to join two "T" grid beam ends at a transition point where the ceiling surface changes from planar to curved, such as in a vaulted ceiling. The splice clip and the various intersection and transition points with which it is utilized is the subject of pending U.S. patent application Ser. No. 08/991,936, filed on Dec. 16, 1998, herein incorporated by reference.

Another type of clip is the splice plate. The splice plate is usually only used in situations where two uncut factory beam ends of curved beams are abutted together in order to create a length of "T" grid beam longer than one beam length. Although a splice clip can also be used in this situation, the splice plate is less costly. The splice clip has two tabs that transversely protrude from the flat portion of the plate at each end of the plate. The tabs are inserted into slots on the "T" grid beam and are bent over to secure the splice plate to the beams. The splice plate also has two small channels formed near the center of the flat portion that are used to capture the ends of each "T" grid beam being spliced together.

Wall attachment clips provide for attachment of a beam to a wall. The wall attachment clip is an elongated "U" shaped clip having a bendable tab at one end. This clip acts as a spacer between the upright web portion of the "T" grid beam and the wall surface, thus allowing the web portion of the "T" grid beam to be secured to the clip and the wall. The bendable tab can be inserted into a slot on the "T" grid beam to further secure the attachment.

In situations where face trim is installed upon a floating edge of a ceiling, the face trim clip is utilized. This clip can be mounted onto a straight "T" grid beam at an end of the beam forming the floating edge. The clip allows the face trim to be clipped onto the clip in transverse, angular, or parallel relation to the beam, thus allowing the face trim to be installed along the floating edge of a suspended grid ceiling independent of how the "T" grid beams intersect the floating edge. The face trim clip and its various installation configurations are the subject of pending U.S. patent application Ser. No. 09/025,272, filed on Feb. 18, 1998, herein incorporated by reference.

The straight "T" grid main beams are provided with keyed slots and cross channel slots spaced at regular intervals along the web portion of the beam. The straight "T" grid cross beams are provided with the keyed slots. The key slots provide an optional method of joining two grid beams and are typically used to join the "T" grid cross beams to the main beam in transverse relation. The straight "T" grid main and cross beams have splice tabs at their beam ends that can be inserted into the keyed slot of another beam. The channel slots of the "T" grid main beams are used to join cross channels to the main beam. The cross channel is an elongated channel with two sidewalls, thus forming a "U" shaped cross-section. The sidewalls can be deflected inwardly at an end of the cross channel and then inserted into the cross channel slots. When the sidewalls spring back to their normal position, a spring force is provided against the cross channel slots, thereby joining the beam and the cross channel.

The suspension grid system is pre-engineered for various installation applications so that specific requirements of a particular installation are pre-determined and the required components are included in the selection of specified components provided by the system. These components are provided in a catalog listing and are organized according to specifications. Of particular importance are the curved grid beams. The curved grid beams are manufactured in various standard radii, chord lengths, and arc angles. Curved grid beams are provided such that the grid beam faces are either concave to create a vault in a ceiling or convex to create a valley in a ceiling. The pre-curved grid beams eliminate the need for "on-site" custom fabrication and modification of straight grid beams to form curved grid beams. Thus, the drywall suspension grid system allows all of the required components for a particular system to be selected and ordered before installation begins at an installation site.

DETAILED DESCRIPTION OF THE INVENTION

A drywall suspension grid system is typically used to construct drywall ceilings incorporating various complex curved features. The system described herein allows for the construction of such curved surfaces by joining various sized and specified preconstructed and pre-engineered components. For instance, the pre-curved grid beams are manufactured in arc angles of 30, 45, 60, and 90 degrees at various radius lengths from 30 to 230 inches. These parameters are only examples as the angles and radii of the pre-curved grid beams can be altered to address market demand. Further, the pre-curved grid beams need not be manufactured in constant radius curves, but can be manufactured to any complex curve. However, by joining the standardized pre-curved grid beams, various curves can be obtained. The pre-curved grid beams also vary in that the beam faces may be either concave to create a vault in the ceiling or concave to create a valley in the ceiling. The use of the pre-curved grid beams also results in a non-faceted mounting surface for the length of any one pre-curved grid beam and for the entire length of the curve created if multiple pre-curved grid beams are joined.

Construction from standard size components and design of the overall grid prior to installation avoids the problem of notches in the grid beams occurring at inopportune locations and ensures consistency of the curved feature. Structural evaluation of the design can also be standardized by the use of standardized components.

The drywall panels to be attached to the grid are curved at the job site by a method generally known in the industry. This method involves wetting the faces of the drywall panel and then bending the panel to the desired shape prior to fastening to the grid.

Figure 1:
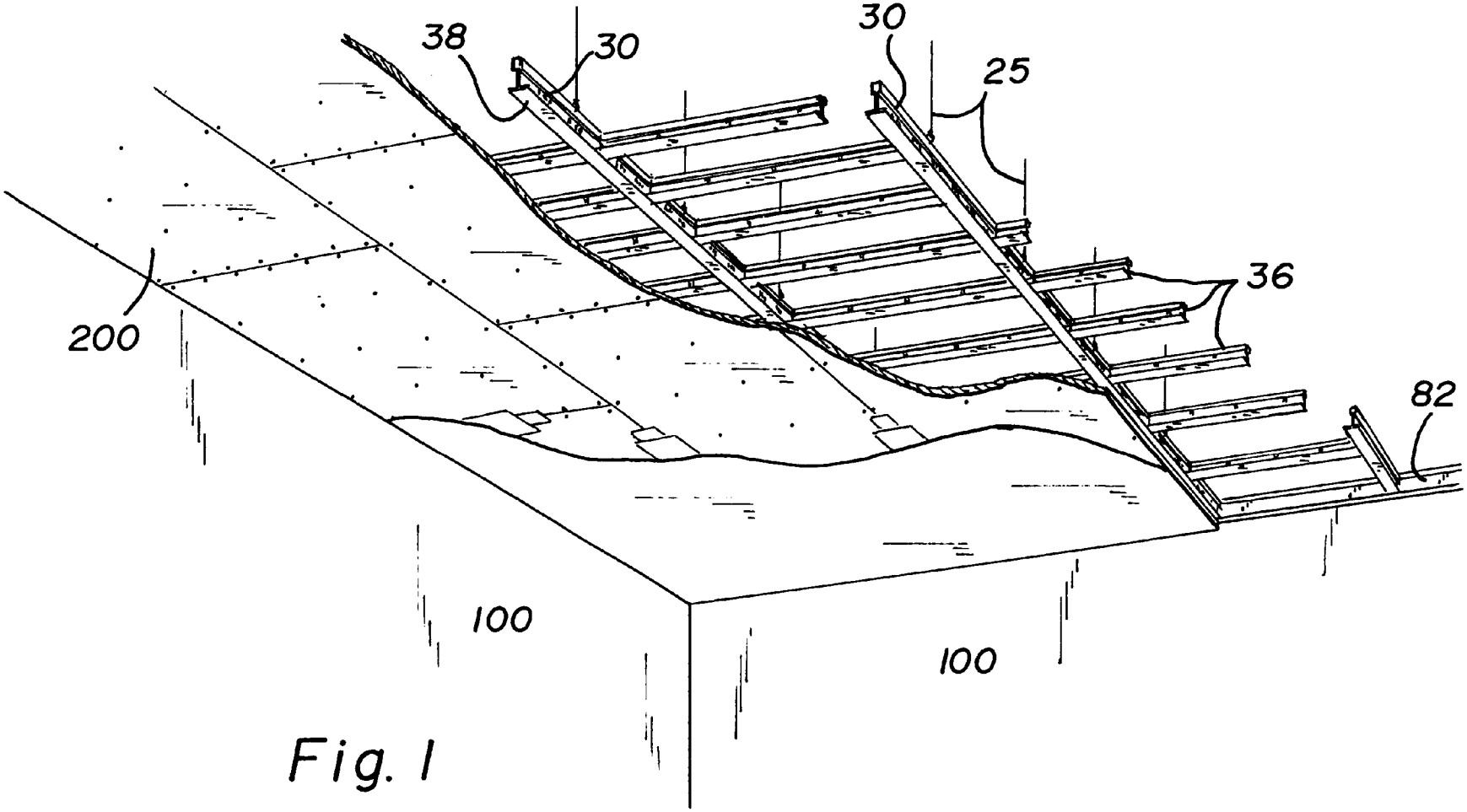
FIG 1. is a perspective view of a flat suspended drywall ceiling showing a portion of the drywall cut away and exposing a drywall suspension grid utilizing straight "T" grid beams forming the flat suspended drywall ceiling.
Figure 1A:
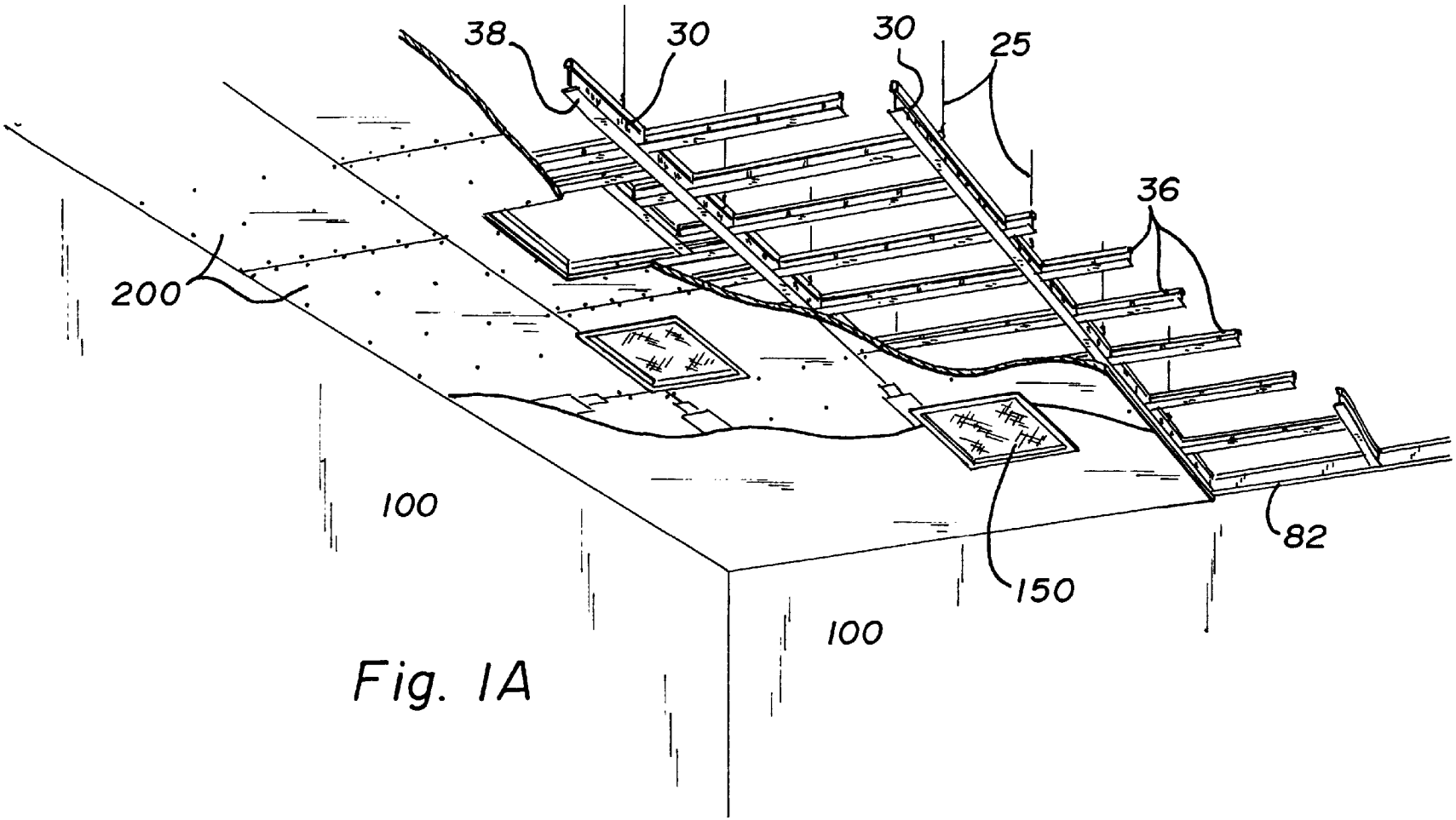
FIG. 1A is a perspective view of a flat suspended drywall ceiling, as depicted in FIG. 1, having utility openings constructed within the drywall suspension grid.

Additionally, the system can also be used to construct a conventional flat suspended drywall ceiling, as depicted in FIG. 1. The flat ceiling is constructed by forming a suspension grid from straight "T" grid main beams 30 and straight "T" grid cross beams 36. Both the straight "T" grid main beams 30 and the straight "T" grid cross beams 36 can be positioned in either the "main" or "cross" position and are therefore interchangeable. For purposes of illustration throughout this specification, the straight "T" grid beams 30 are in the "main" position and the straight "T" grid beams 36 are in the "cross" position. The straight "T" grid main beams 30 and cross beams 36 are suspended from supporting structure (not shown) by a plurality of hanger wires 25. In this configuration, channel molding 82 is used to capture the ends of the straight "T" grid main beams 30 and the straight "T" grid cross beams 36 that meet wall surfaces 100. Each of the straight "T" grid main beams 30 and straight "T" grid cross beams 36 have a grid beam face 38, which collectively provide a surface upon which drywall panels 200 can be mounted using drywall screws. FIG. 1A shows a flat suspended drywall ceiling that incorporates several utility openings 150. Utility openings 150 provide space for lighting fixtures, vents, or other fixtures.

Figure 2:
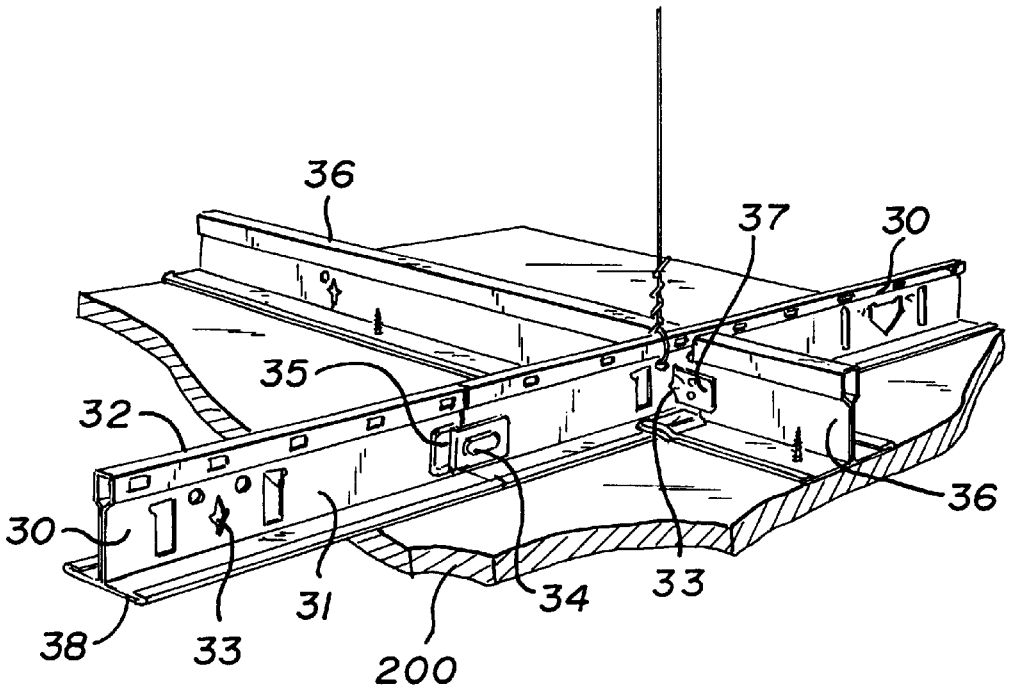
FIG. 2 is a detailed perspective view of a typical intersection point of two straight "T" grid beams transverse to each other in the drywall suspension grid of FIG. 1.

FIG. 2 shows a typical intersection point encountered in a suspension grid, such as in FIGS. 1 and 1A, between a straight "T" grid main beam 30 and two straight "T" grid cross beams 36. The "T" grid beams 30 and 36 have a vertical web portion 31 and a thicker top bulb portion 32. A splice tab 37 is provided at the end of both straight "T" grid cross beams 36 and is inserted into a keyed slot 33 on the web portion 31 of the straight "T" grid main beam 30. FIG. 2 also shows one embodiment of a splice connection between two straight "T" grid main beams 30. A main splice tab 34 is provided at the ends of the straight "T" grid main beams 30 and is inserted through and bent around an end slot 35 on the web portion 31 of the other straight "T" grid main beam 30. Drywall panels 200 are then mounted to a grid beam face 38 on the straight "T" grid main beams 30 and the straight "T" grid cross beams 36.

Figure 2A:
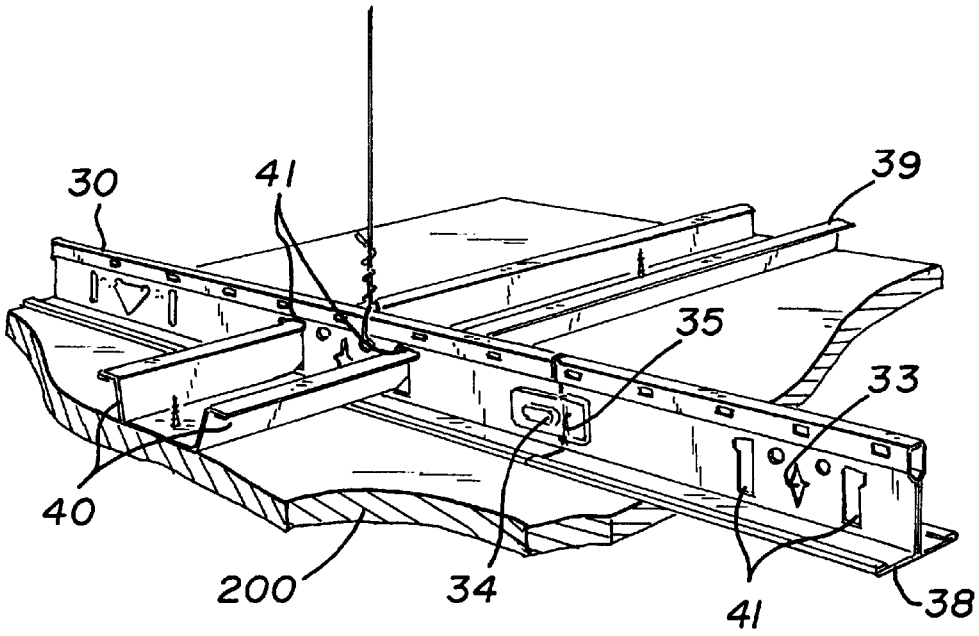
FIG. 2A is a perspective view of an intersection point between a straight "T" grid beam and a cross channel in a flat suspended drywall ceiling.

FIG. 2A shows a similar type of intersection point as that of FIG. 2, which utilizes a cross channel 39 in lieu of a straight "T" grid cross beam 36. The cross channel 39 is an elongated "U" shaped beam that has channel sidewalls 40. The channel sidewalls 40 can be deflected inwardly and inserted into cross channel slots 41 provided on the straight "T" grid main beam 30. The resulting spring force of the deflected channel sidewalls 40 holds the cross channel 39 in place. The cross channel 39, together with the grid beam face 38 of the straight "T" grid main beams 30, provide the grid face surface upon which drywall panels 200 may be mounted.

Figure 3:
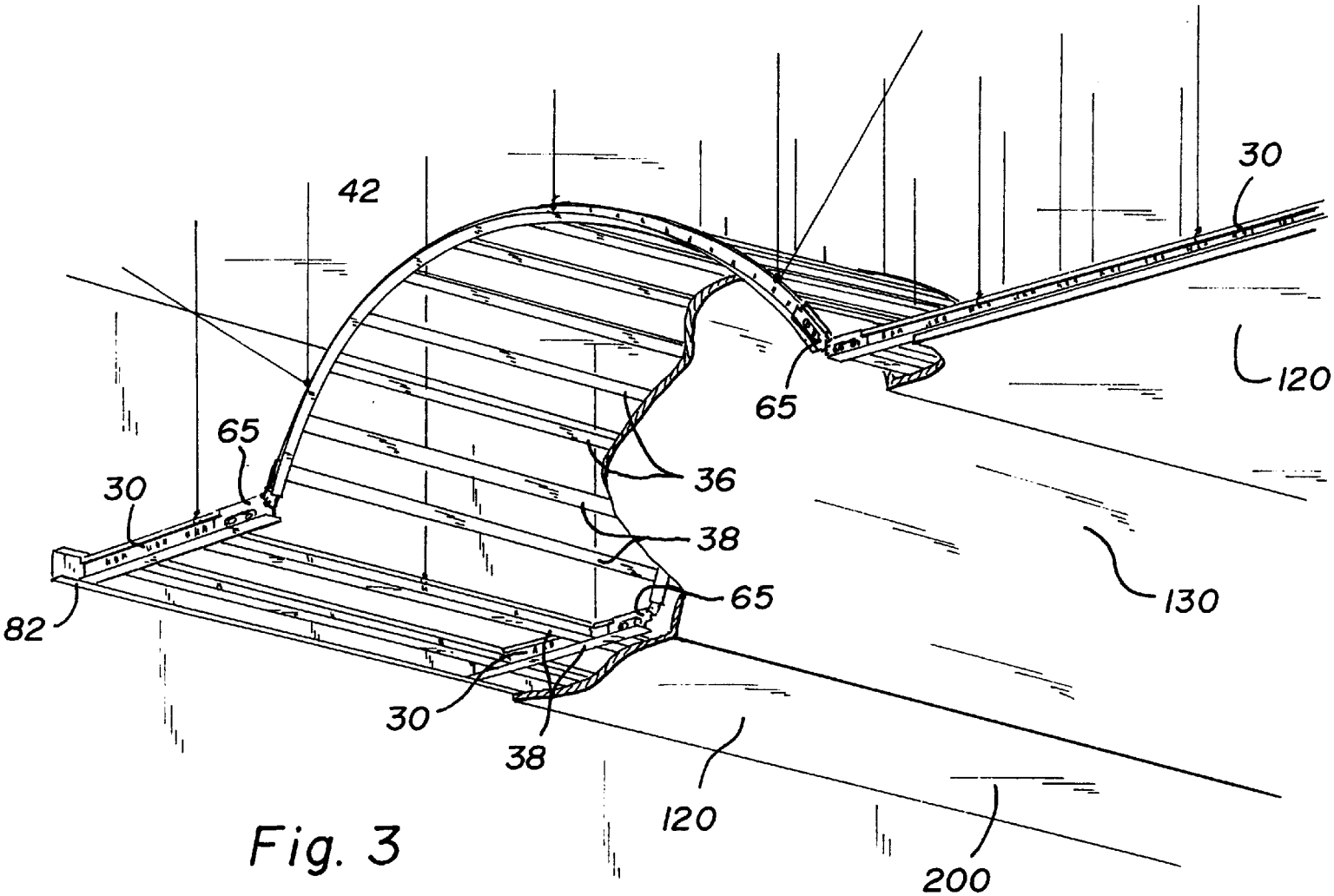
FIG. 3 is a perspective view of a suspended drywall ceiling showing a portion of the drywall cut away and exposing a drywall suspension grid utilizing straight "T" grid beams and concave curved "T" grid beams forming a suspended drywall ceiling having a vault portion.
Figure 4:
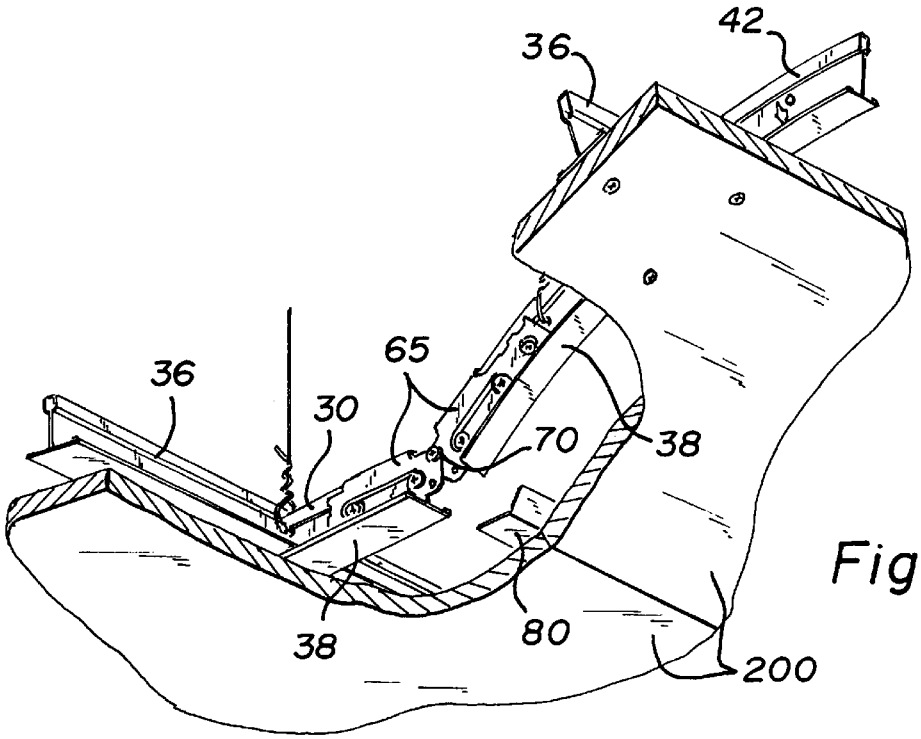
FIG. 4 is a detailed perspective view of a transition point between a straight "T" grid beam and a concave curved "T" grid beam in the drywall suspension grid of FIG. 3.

A suspended drywall ceiling having flat portions 120 a vaulted portion 130 is shown in FIG. 3. The flat portions 120 of the ceiling are created by straight "T" grid main beams 30 extending from channel molding 82, which is mounted to the walls 100 of the room. The channel molding 82 is used to capture the end of the straight "T" grid main beams 30 that terminate at the wall 100. The vaulted portion 130 is created by joining the end of each straight "T" grid main beam 30 to an end of a concave curved "T" grid beam 42, as shown in FIG. 4. A modified splice clip 65 is used to join the ends of both the straight "T" grid main beam 30 and the concave curved "T" grid beam 42 at each such transition point within the suspended grid as shown in FIG. 3. The modified splice clip 65 is a splice clip 64 (shown in FIG. 7) severed in half and pinned together at a pivot point 70, thus allowing the straight "T" grid main beam 30 to be joined to the end of the concave curved "T" grid beam 42 at any angle. The splice clip 65 fits over the bulb portion 32 and bears against the web portion 31 of both the straight "T" grid main beam 30 and the concave curved "T" grid beam 42. The splice clip 64 and the modified splice clip 65 are the subject of pending U.S. patent application Ser. No. 08/991,936, filed on Dec. 16, 1998, herein incorporated by reference. A number of straight "T" grid cross beams 36 are joined in transverse relation to the straight "T" grid main beams 30 and the concave curved "T" grid beams 42, thus creating the complete suspension grid shown in FIG. 3. Angle molding 80 is provided along the corner formed between the flat portions 120 and vaulted portion 130 of the ceiling, as shown in FIG. 4. Drywall panels 200 are then formed and mounted to the grid beam faces 38 of the suspension grid.

Figure 5:
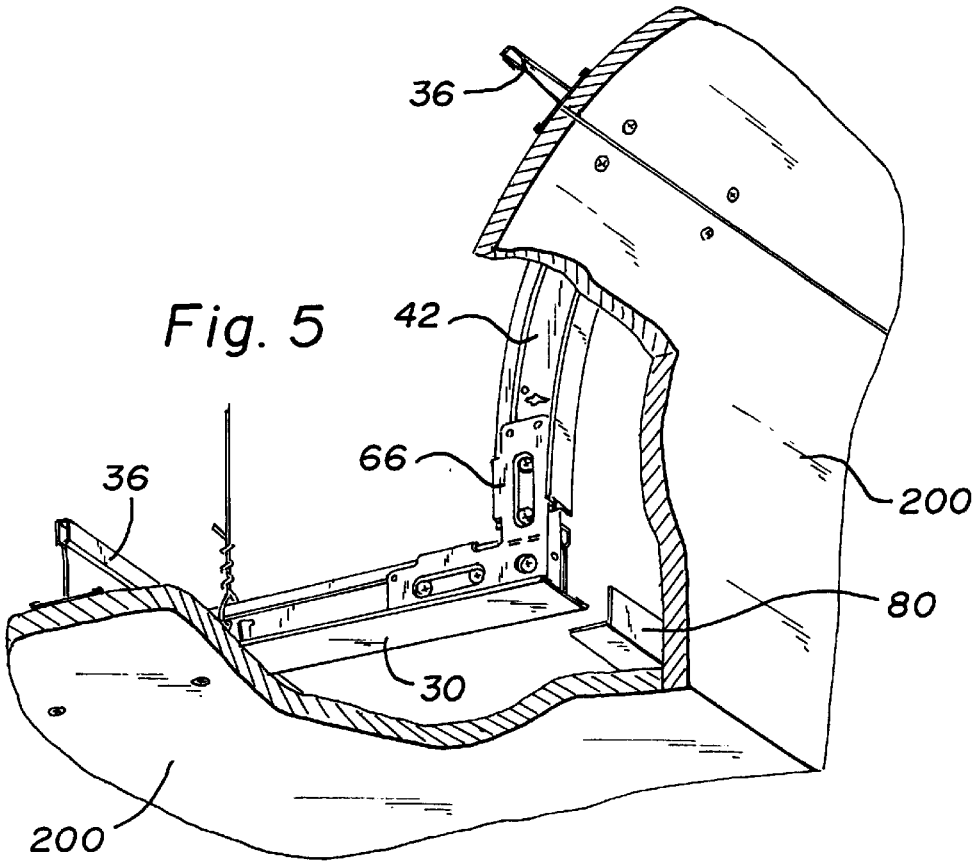
FIG. 5 is a perspective view of a second embodiment of a transition point between a straight "T" grid beam and a concave curved "T" grid beam in a drywall suspension grid forming a suspended drywall ceiling having a vault portion.

FIG. 5 shows an alternate embodiment of a transition point between a straight "T" grid main beam 30 and a concave curved "T" grid beam 42 in a suspended drywall ceiling having a vaulted portion similar to that of FIG. 3. This embodiment utilizes a transition clip 66 to join an end of a concave curved "T" grid beam 42 that is perpendicular to a straight "T" grid main beam 30. The transition clip 66 is a right angle clip that mounts onto both the concave curved "T" grid beam 42 and the straight "T" grid main beam 30 and is secured thereto by screws. The transition clip 66 fits over the bulb portion 32 and bears against the web portion 31 of both the straight "T" grid main beam 30 and the concave curved "T" grid beam 42. The transition clip 66 and its specific applications is the subject of pending U.S. patent application Ser. No. 08/991,935, filed on Dec. 16, 1998, herein incorporated by reference.

Figure 6:
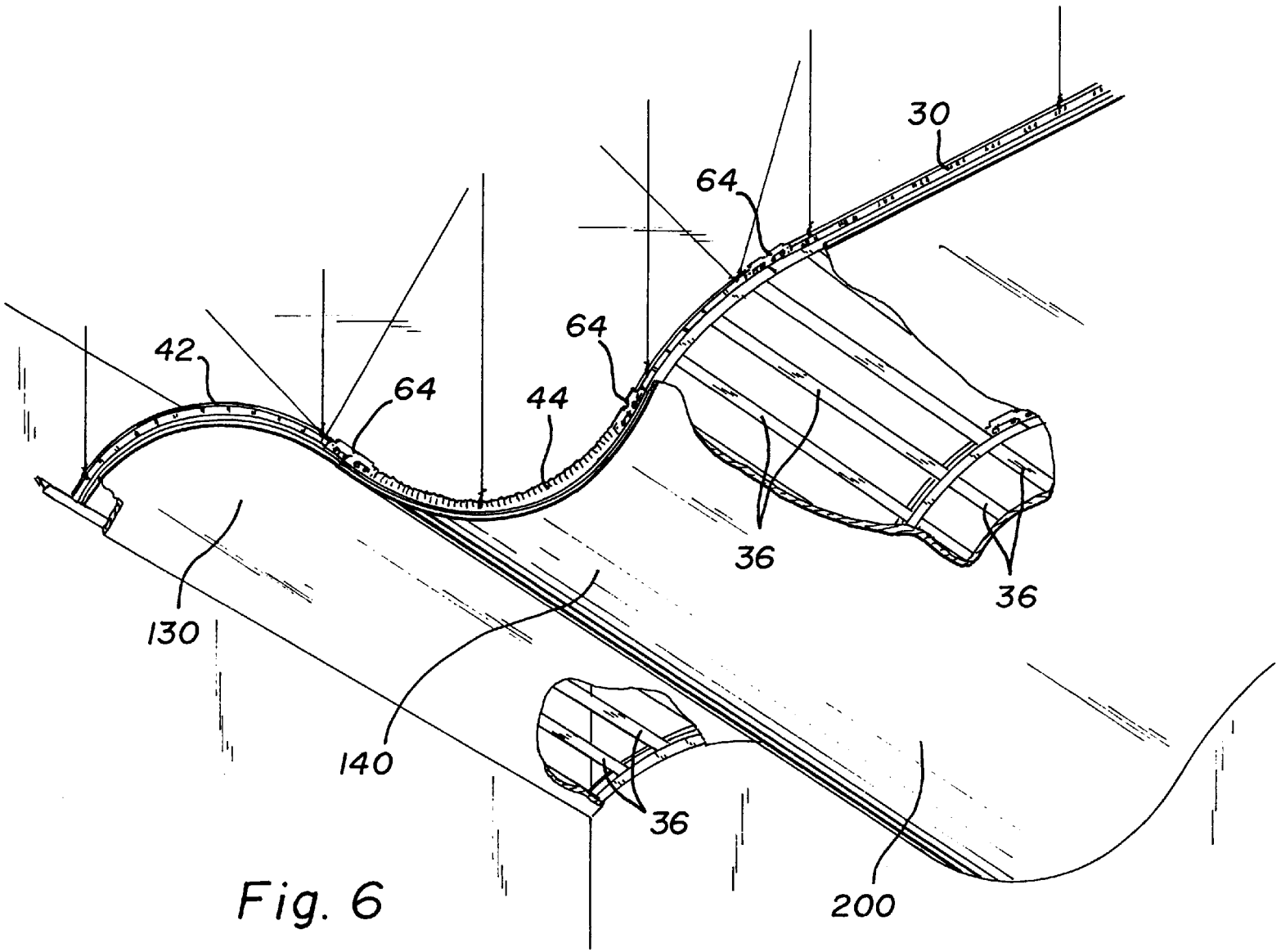
FIG. 6 is a perspective view of a suspended drywall ceiling showing a portion of the drywall cut away and exposing a drywall suspension grid having straight "T" grid beams, concave curved "T" grid beams, and convex curved "T" grid beams forming the suspended drywall ceiling having a flat portion, a vault portion, and a valley portion.

A suspended drywall ceiling having a vaulted portion 130 and a valley portion 140 is shown in FIG. 6. In this type of application, concave curved "T" grid beams 42 are used to create the vault portion 130 of the ceiling and convex curved "T" grid beams 44 are used to create the valley portion 140 of the ceiling. A number of straight "T" grid cross beams 36 are joined in transverse relation to the straight "T" grid main beams 30, the concave curved "T" grid beams 42, and the convex curved "T" grid beams 44, thus creating the complete suspension grid shown in FIG.3. These beams are joined together by the use of any of the means described herein. The straight "T" grid cross beams 36 are typically joined to the transverse beams (30, 42, and 44) by the use of splice tabs 37 provided at the end of the straight "T" grid cross beams 36. Splice tabs 37 are inserted into the keyed slot 33 on the web portion 31 of the other transversely positioned beams (30, 42, and 44).

Figure 7:
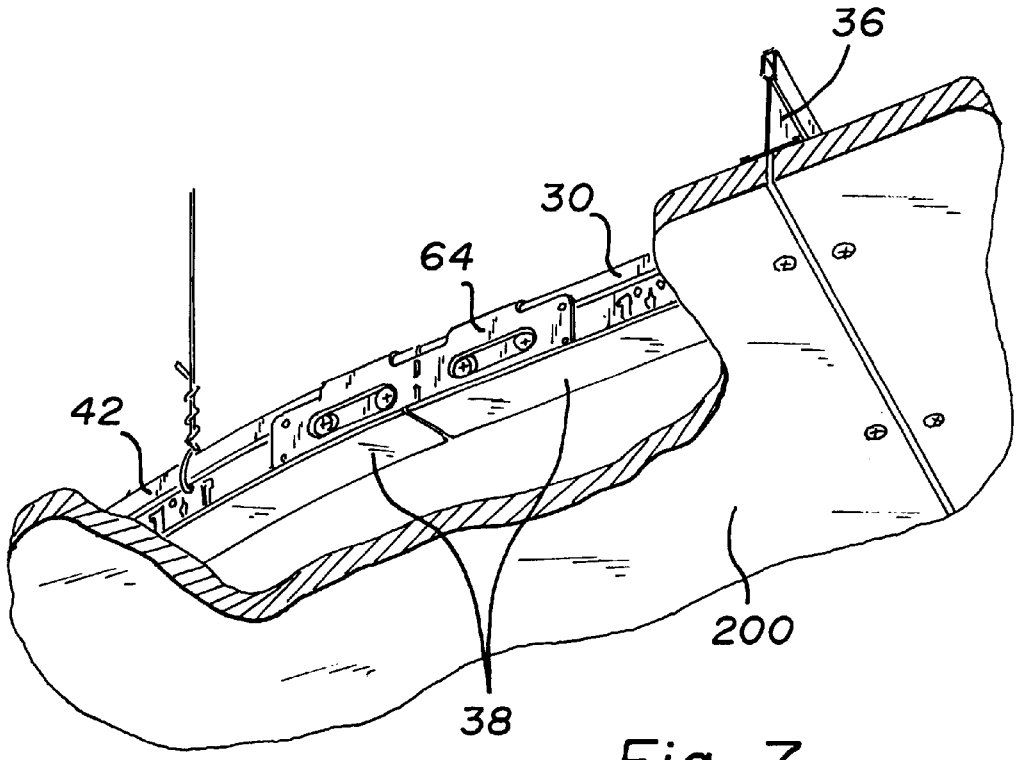
FIG. 7 is a detailed perspective view of a transition point between a concave curved "T" grid beam and straight "T" grid beam in the drywall suspension grid of FIG. 6.
Figure 8:
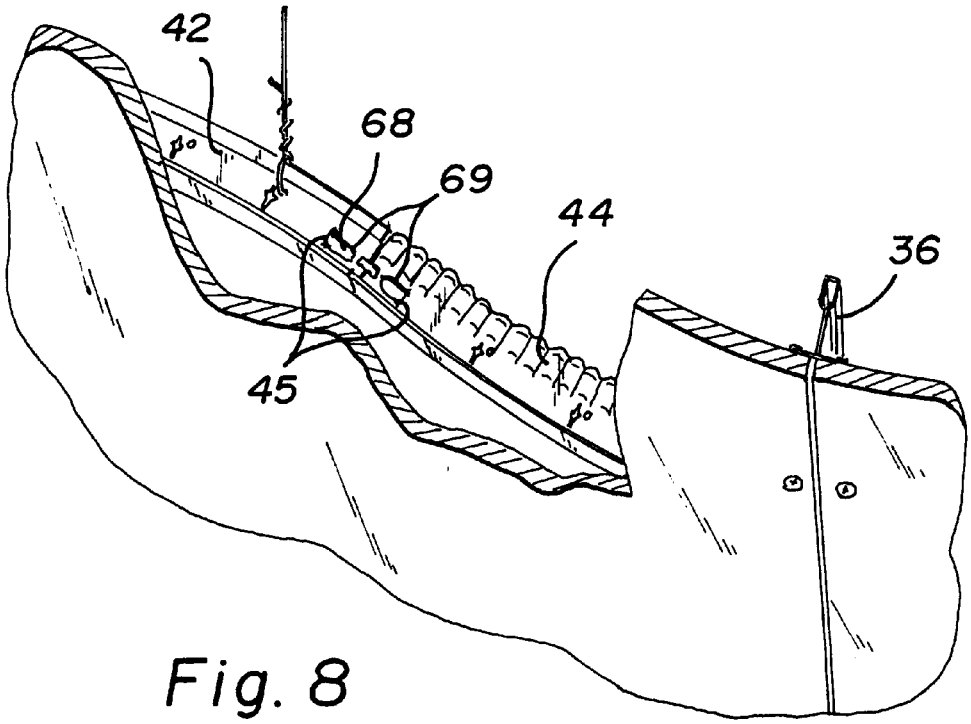
FIG. 8 is a detailed perspective view of a transition point between a concave curved "T" grid beam and a convex curved "T" grid beam in the drywall suspension grid of FIG. 6.

FIG. 7 shows a transition point between the concave curved "T" grid beam 42 and the straight "T" grid main beam 30 depicted in FIG. 6. A splice clip 64 is mounted to both beams and secured thereto with screws. The splice clip fits over the bulb portion 32 and bears against the integrally continuous web portion 31 of the concave curved "T" grid beam 42 and the straight "T" grid main beam 30. FIG. 8 shows a transition point between the concave curved "T" grid beam 42 and the convex curved "T" grid beam 44 depicted in FIG. 6. A splice plate 68 is provided with tabs 69 which are inserted through and bent around curved beam end slots 45 on both the concave curved "T" grid beam 42 and the convex curved "T" grid beam 44, thus securing the two beams together.

Figure 9:
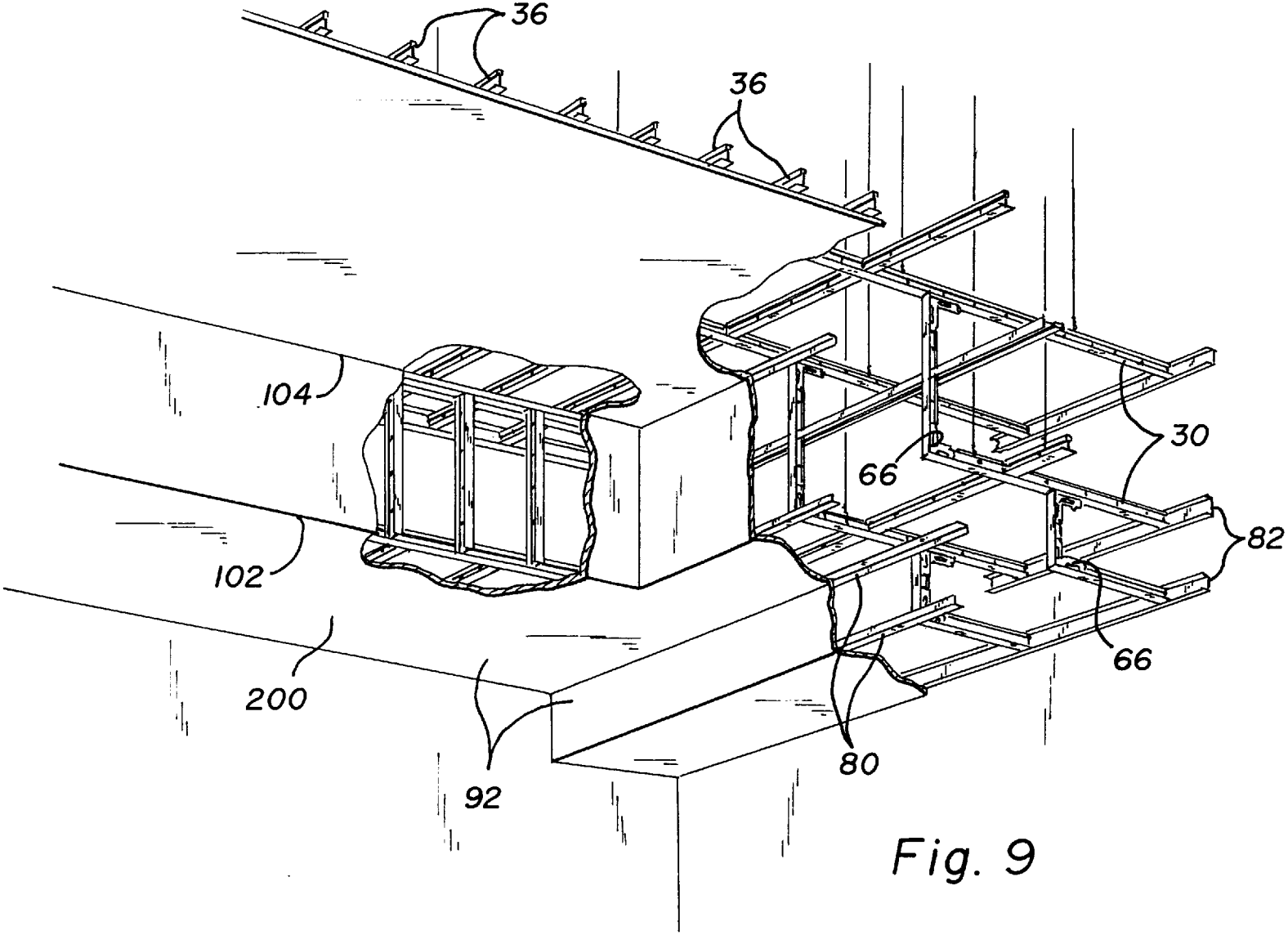
FIG. 9 is a perspective view of a suspended drywall ceiling showing a portion of the drywall cut away and exposing a drywall suspension grid having straight "T" grid beams forming the suspended drywall ceiling having boxed soffits.
Figure 10:
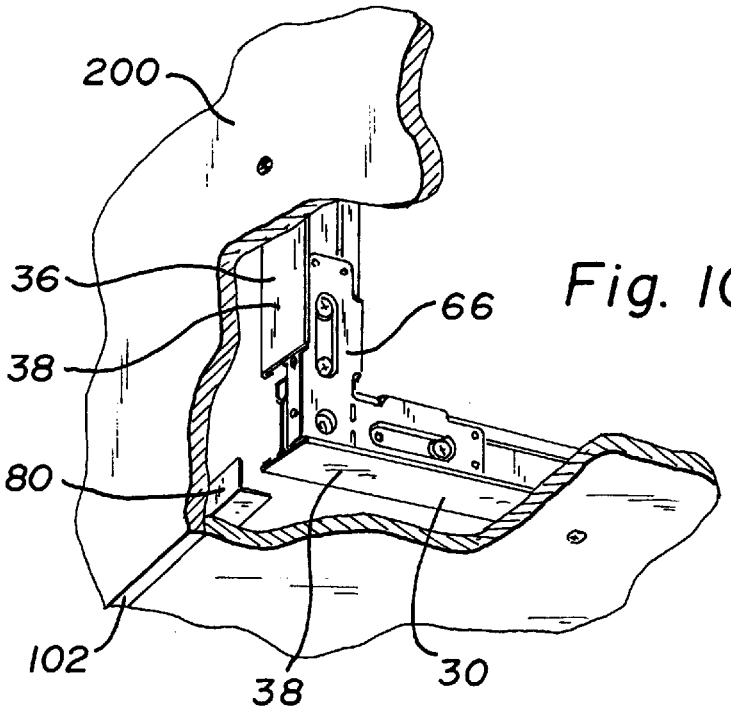
FIG. 10 is a detailed perspective view of a transition point between two straight "T" grid beams transverse to each other and forming with an angle molding an outside bottom corner of the boxed soffits in the drywall suspension grid of FIG. 9.
Figure 11:
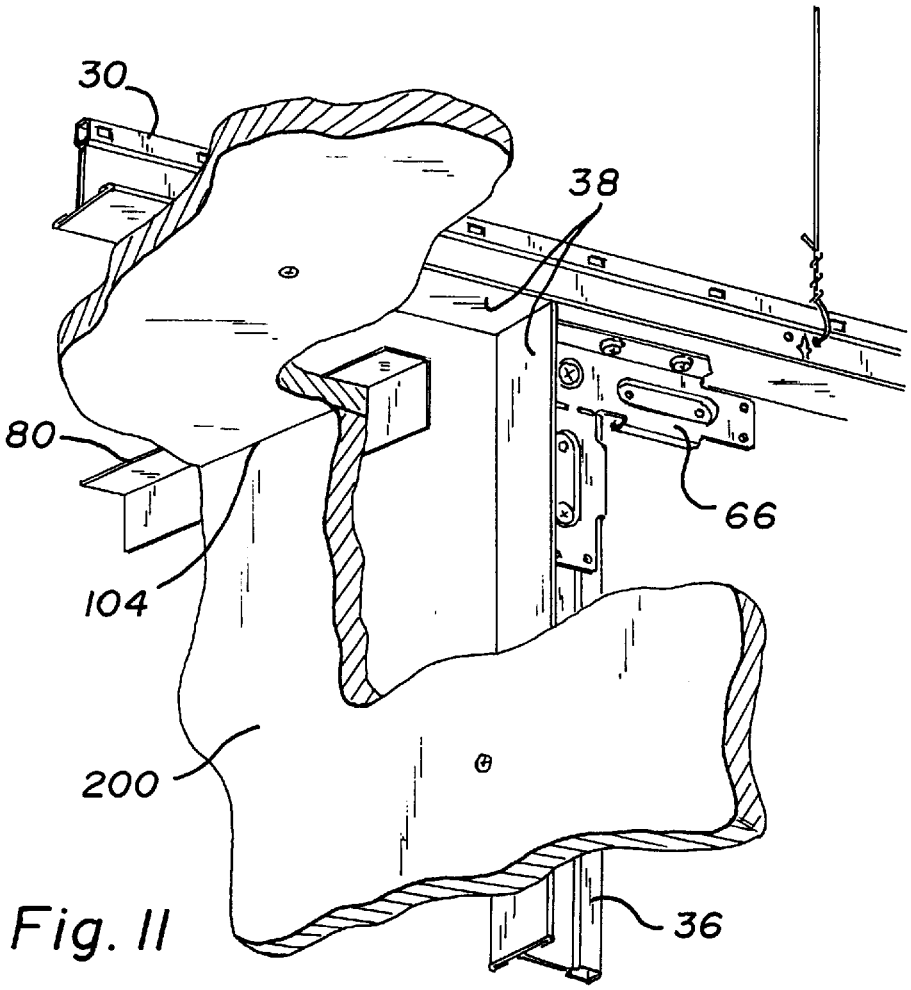
FIG. 11 is a detailed perspective view of a transition point between two straight "T" grid beams transverse to each other and forming with an angle molding an inside top corner of the boxed soffits in the drywall suspension grid of FIG. 9.

FIG. 9 shows a suspended drywall ceiling constructed from a suspension grid having boxed soffits 92. The boxed soffits 92 are constructed from a number of straight "T" grid main beams 30 and straight "T" grid cross beams 36. Both the straight "T" grid main beams 30 and the straight "T" grid cross beams 36 can be positioned in either the "main" or "cross" position and are therefore interchangeable. FIG. 10 depicts a transition point between a straight "T" grid main beam 30 and a straight "T" grid cross beam 36 transverse to each other and forming with an angle molding 80 an outside bottom corner 102 of the boxed soffits 92 shown in the drywall suspension grid of FIG. 9. The straight "T" grid main beam 30 and a straight "T" grid cross beam 36 are joined by a right angle transition clip 66. The transition clip 66 is mounted to the "T" grid beams 30 and 36 and secured thereto by screws. FIG. 11 depicts a transition point between a straight "T" grid main beam 30 and a straight "T" grid cross beam 36 transverse to each other and forming with an angle molding 80 an inside top comer 104 of the boxed soffits 92 shown in the drywall suspension grid of FIG. 9. In the configuration shown in FIG. 1, the end of the straight "T" grid cross beam 36 abuts against the grid beam face 38 of the straight "T" grid main beam 30, thus creating the inside comer 104 of the boxed soffits 92. A transition clip 66 is mounted to both "T" grid beams 30 and 36 and secured thereto by screws. In this configuration, the transition clip 66 is mounted directly to the grid beam face 38 of the straight "T" grid main beam 30 and does not bear against the web portion 31 of this beam.

Figure 12:
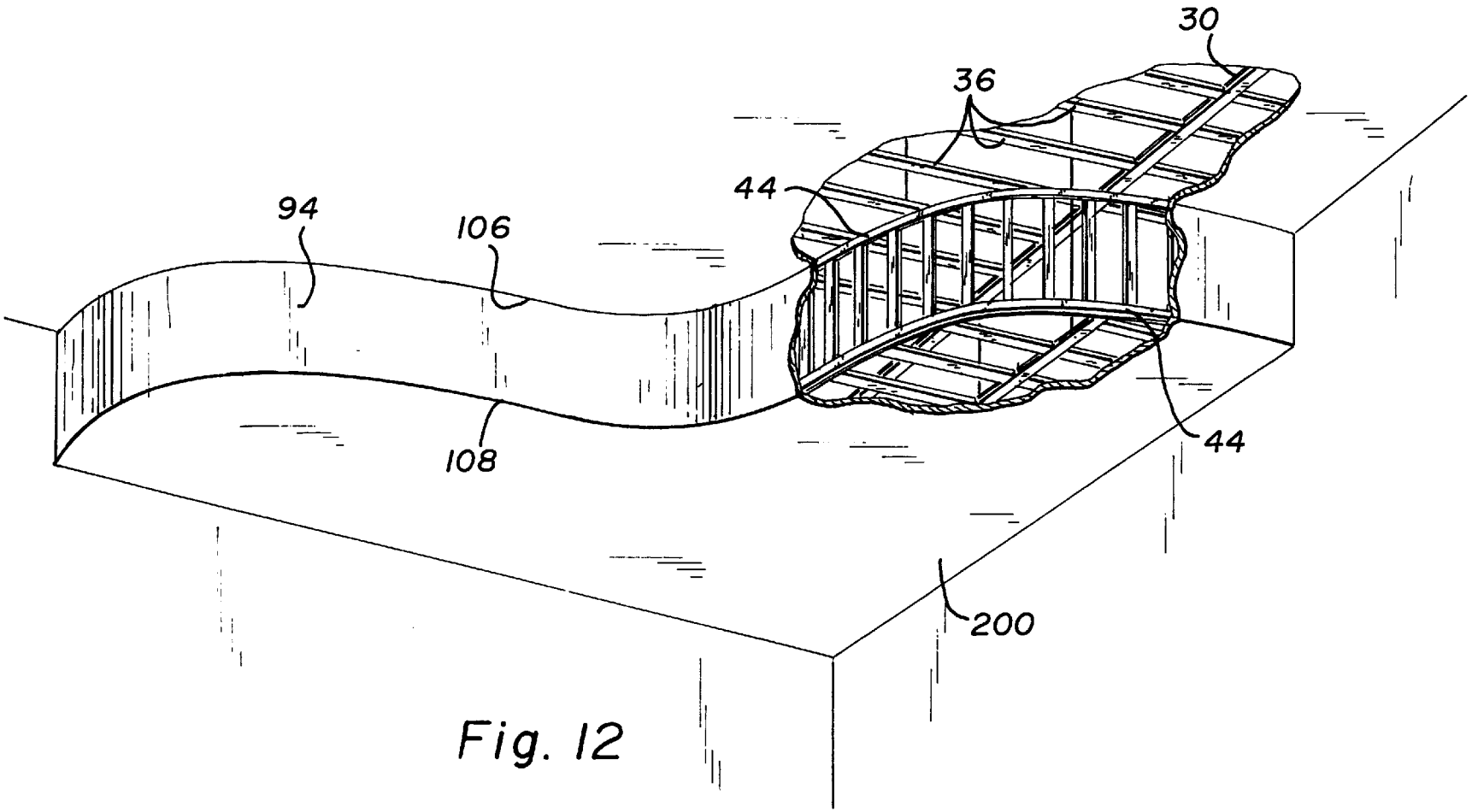
FIG. 12 is a perspective view of a suspended drywall ceiling showing a portion of the drywall cut away and exposing a drywall suspension grid having concave and convex curved "T" grid beams and straight "T" grid beams forming a serpentine soffit fascia in a suspended drywall ceiling.
Figure 13:
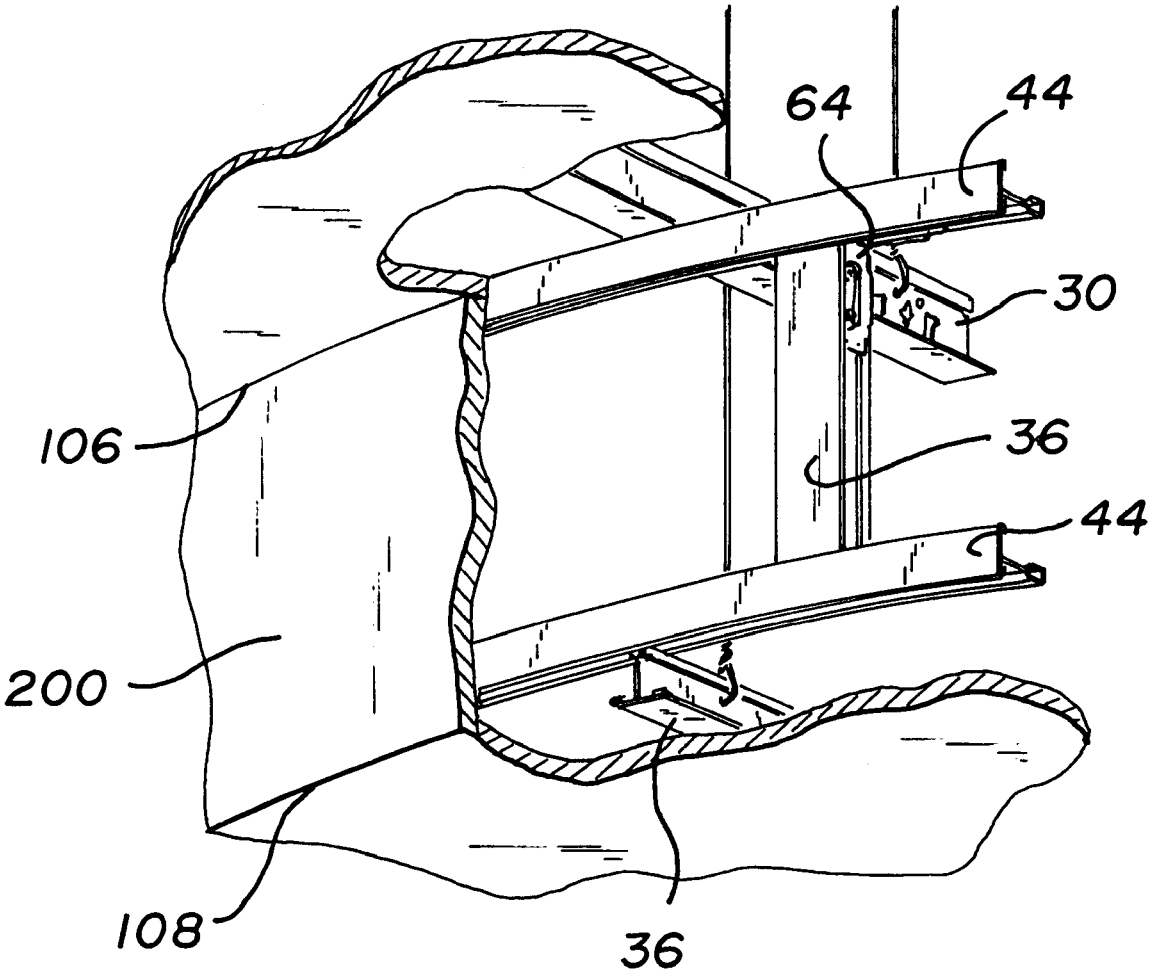
FIG. 13 is a detailed perspective view of the curved "T" grid beams forming an inside corner and an outside corner of the serpentine soffit in the drywall suspension grid of FIG. 12.

FIG. 12 shows a suspended drywall ceiling constructed from a drywall suspension grid having concave and convex curved "T" grid beams 42 and 44, and straight "T" grid main beams 30 and straight "T" grid cross beams 36 forming a suspended drywall ceiling having a serpentine soffit 94. FIG. 13 shows the detailed construction of an inside comer 106 and an outside comer 108 of the serpentine soffit 94 in the drywall suspension grid of FIG. 12. In this construction, a vertical straight "T" grid cross beam 36 is positioned in transverse relation between two convex curved "T" grid beams 44. A splice clip 64 is bent at a right angle so that it can be mounted to both the vertical short straight "T" grid cross beam 36 and the convex curved "T" grid beam 44 in a transverse relation to each other. This type of configuration of splice clip 64 is used at both ends of the vertical straight "T" grid cross beam 36. The flat portions of the ceiling are constructed using straight "T" grid main beams 30 and straight "T" grid cross beams 36.

Figure 14:
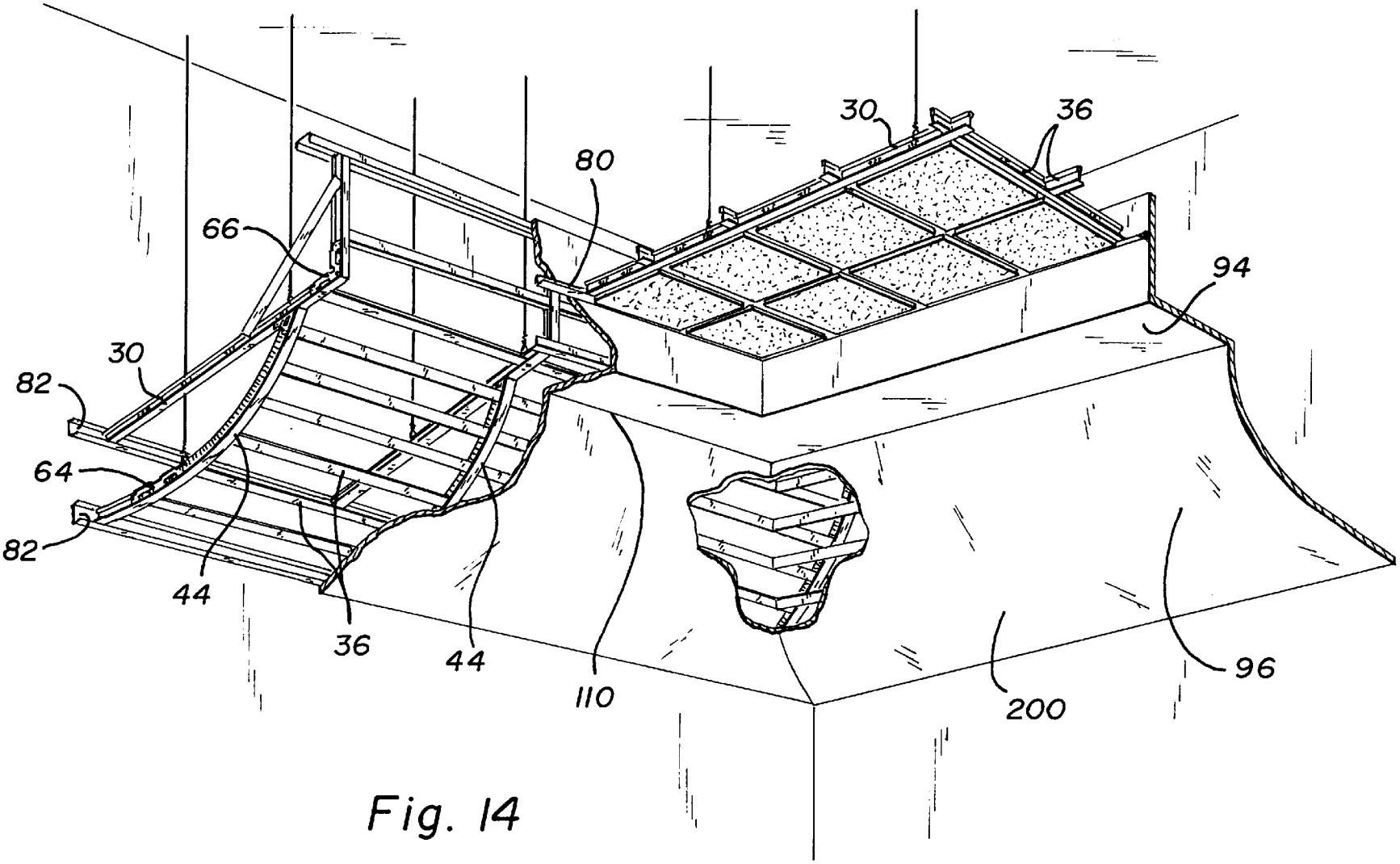
FIG. 14 is a perspective view of a suspended drywall ceiling showing a portion of the drywall cut away and exposing a drywall suspension grid having convex curved "T" grid beams and straight "T" grid beams forming the suspended drywall ceiling having a boxed soffit and a curved soffit.
Figure 15:
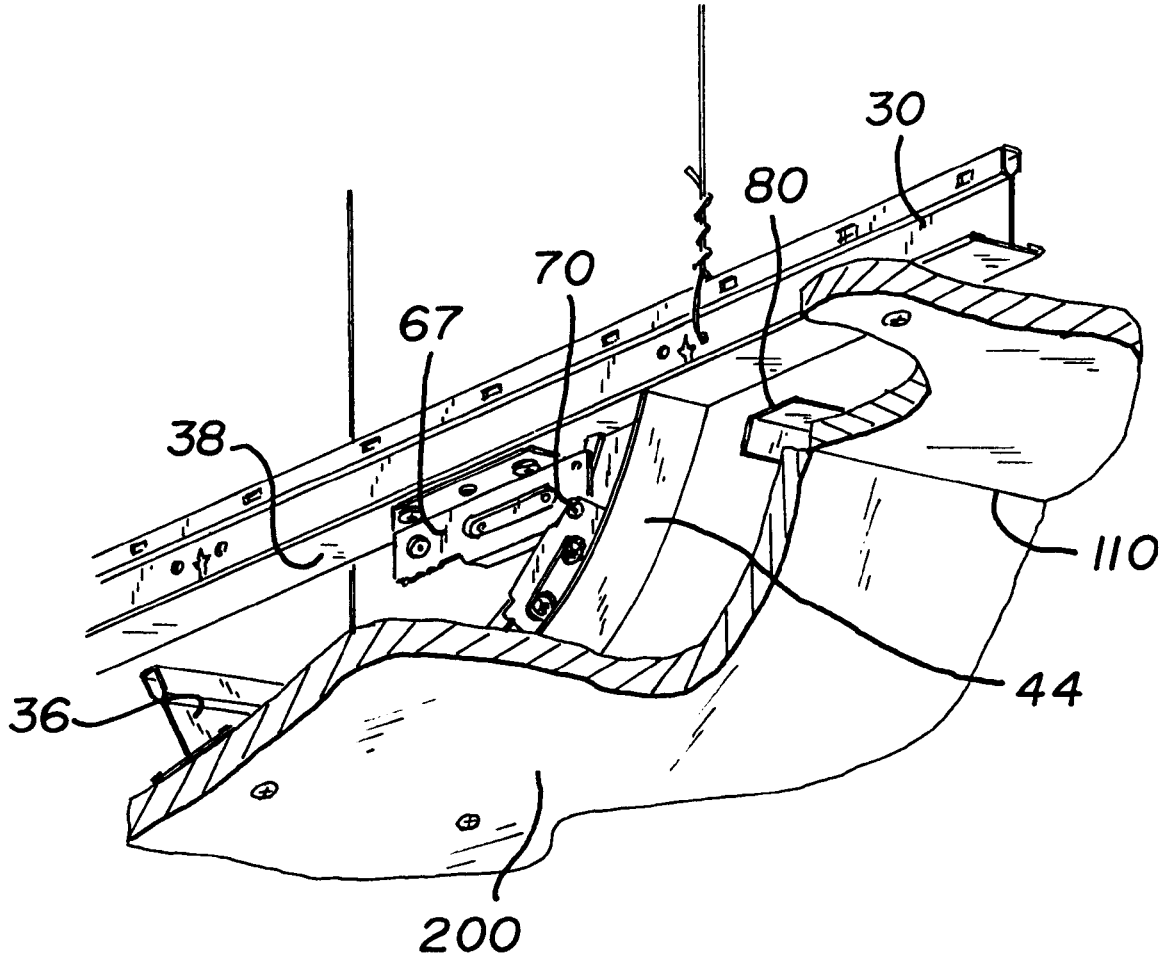
FIG. 15 is a detailed perspective view of a transition point between a straight "T" grid beam and a convex curved "T" grid beam in transverse relation to each other and forming with an angle molding, an obtuse comer between the curved soffit and the boxed soffit of FIG. 14.

FIG. 14 shows a suspended drywall ceiling constructed from a drywall suspension grid having convex curved "T" grid beams 44, and straight "T" grid main beams 30 and straight "T" grid cross beams 36 forming a suspended drywall ceiling having a boxed soffit 94 and a curved soffit 96. In this ceiling configuration, the curved soffit 96 meets the boxed soffit 94 at a transition point between a concave curved "T" grid beam 44 and a straight "T" grid main beam 30 creating a corner 110, as shown in FIG. 15. A modified transition clip 67 is used to join the end of the convex curved "T" grid beam 44 to the grid beam face 38 of the straight "T" grid main beam 30. The modified transition clip 67 is a transition clip 66 (shown in FIG. 5) severed into two pieces and pinned together at a pivot point 70. The modified transition clip 67 and its application is disclosed in pending U.S. patent application Ser. No. 08/991,935, filed on Dec. 16, 1998, herein incorporated by reference. Angle molding 80 is added to reinforce the corner 110 formed between the boxed soffit 94 and the curved soffit 96.

Figure 16:
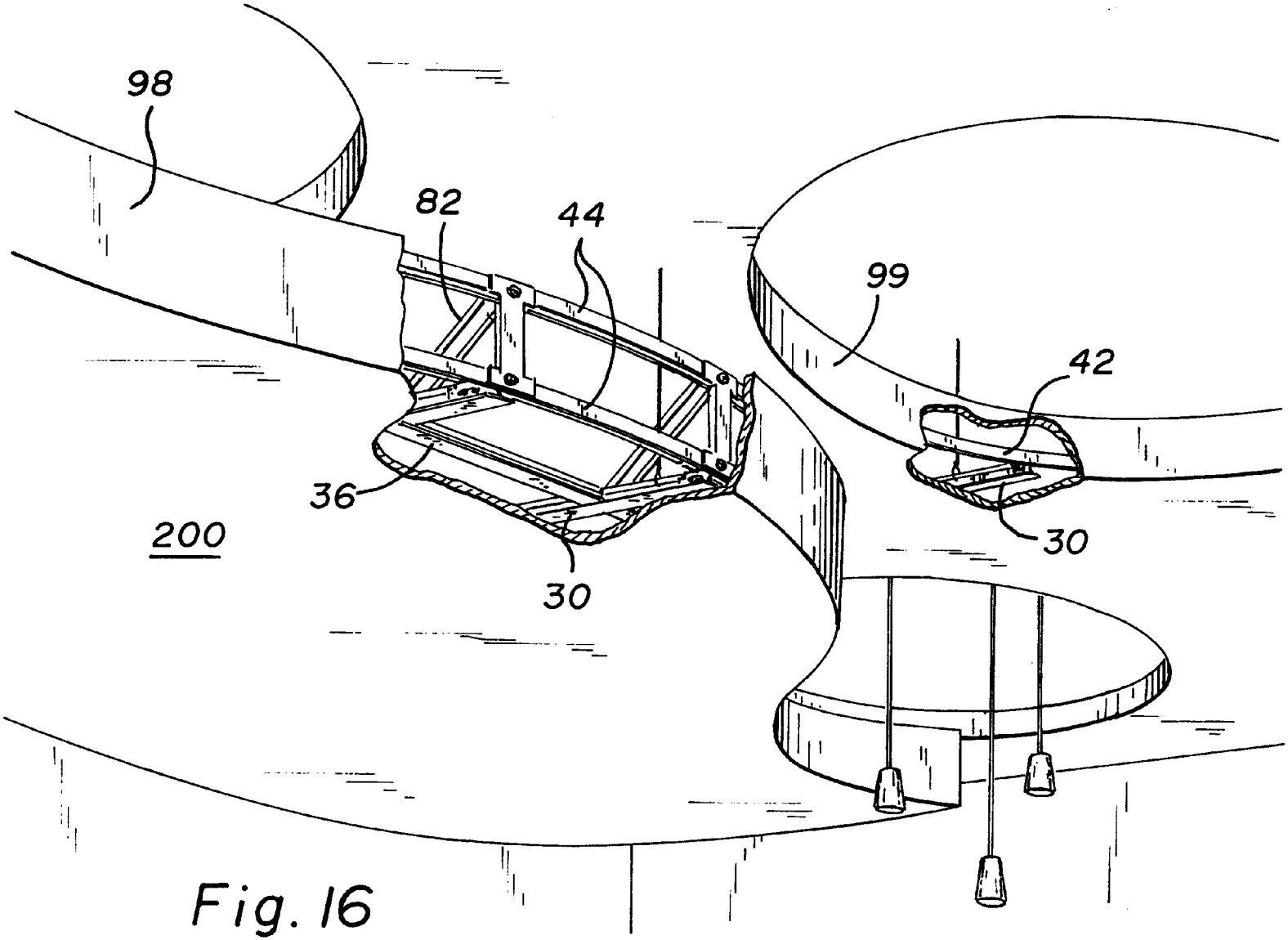
FIG. 16 is a perspective view of a suspended drywall ceiling showing a portion of the drywall cut away and exposing a drywall suspension grid having concave and convex curved "T" grid beams and straight "T" grid beams forming a serpentine fascia on a flat suspended drywall ceiling.
Figure 17:
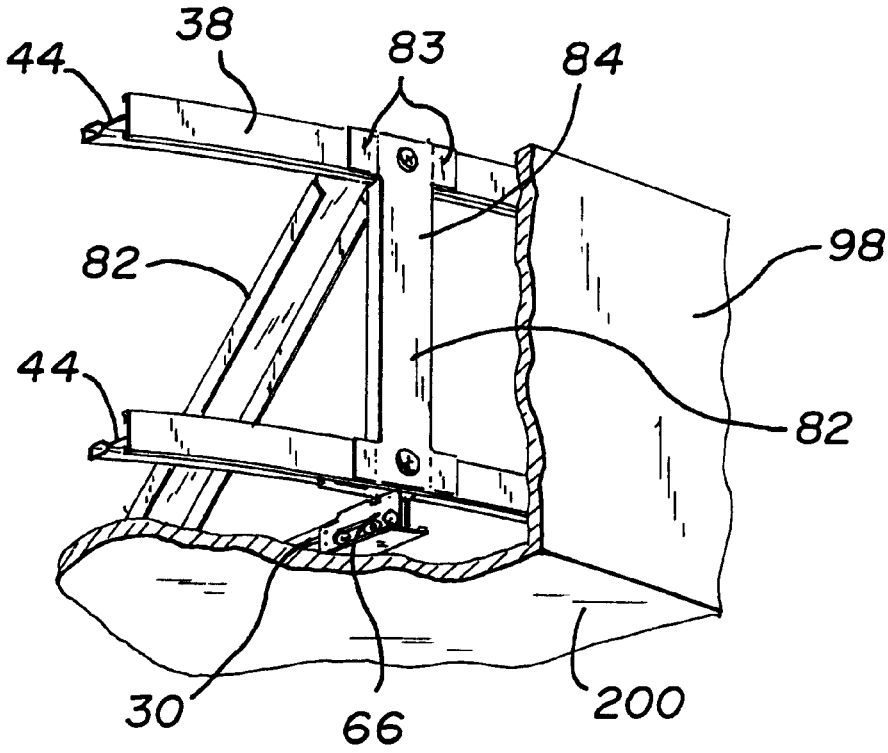
FIG. 17 is a detailed perspective view of the curved "T" grid beams forming a first embodiment of the serpentine fascia of FIG. 16.

FIG. 16 shows a suspended drywall ceiling constructed from a drywall suspension grid having concave and convex curved "T" grid beams 42 and 44, and straight "T" grid main beams 30 and straight "T" grid cross beams 36 forming a flat suspended drywall ceiling having a serpentine fascia 98 and a circular fascia 99. FIG. 17 shows the construction between the curved "T" grid beams 44 forming the serpentine fascia 98 of FIG. 16. Channel molding 82 is cut and notched so that it can be bent over the top convex curved "T" grid beam 44 and angled downward toward the straight "T" grid main beam 30. Tabs 83 are bent outwardly such that the channel molding 82 lies flat against the grid beam face 38 of the curved "T" grid beams 44 and forms a channel face 84. The straight "T" grid main beam 30 is mounted to the bottom curved "T" grid beam 44 via a bent transition clip 66. The transition clip 66 is bent at a right angle, thus allowing it to be mounted to the straight "T" grid main beam 30 and the bottom curved "T" grid beam 44 in transverse relation to each other, as shown in FIG. 17. The grid beam face 38 of the curved "T" grid beams 44 and the channel face 84 create the surface upon which drywall panels 200 can be mounted to create the serpentine fascia 98.

Figure 18:
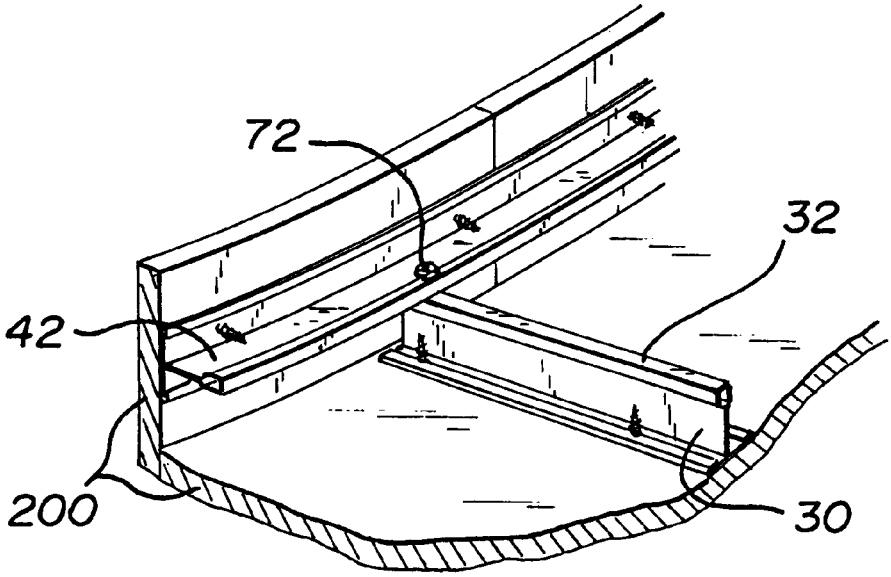
FIG. 18 is a detailed perspective view of a transition point between a horizontal straight "T" grid beam and a concave curved "T" grid beam transverse to each other and forming the corner of a second embodiment of the serpentine fascia of FIG. 16.

FIG. 18 shows an intersection point between a straight "T" grid main beam 30 and a concave curved "T" grid beam 42 of the circular fascia 99 of FIG. 16. A straight "T" grid cross beam 36 (shown in FIG. 2) could also be used in place of the straight "T" grid main beam 30. In this configuration, the concave curved "T" grid beam 42 is directly mounted to the top bulb portion 32 of the straight "T" grid main beam 30 via a screw 72.

Figure 19:
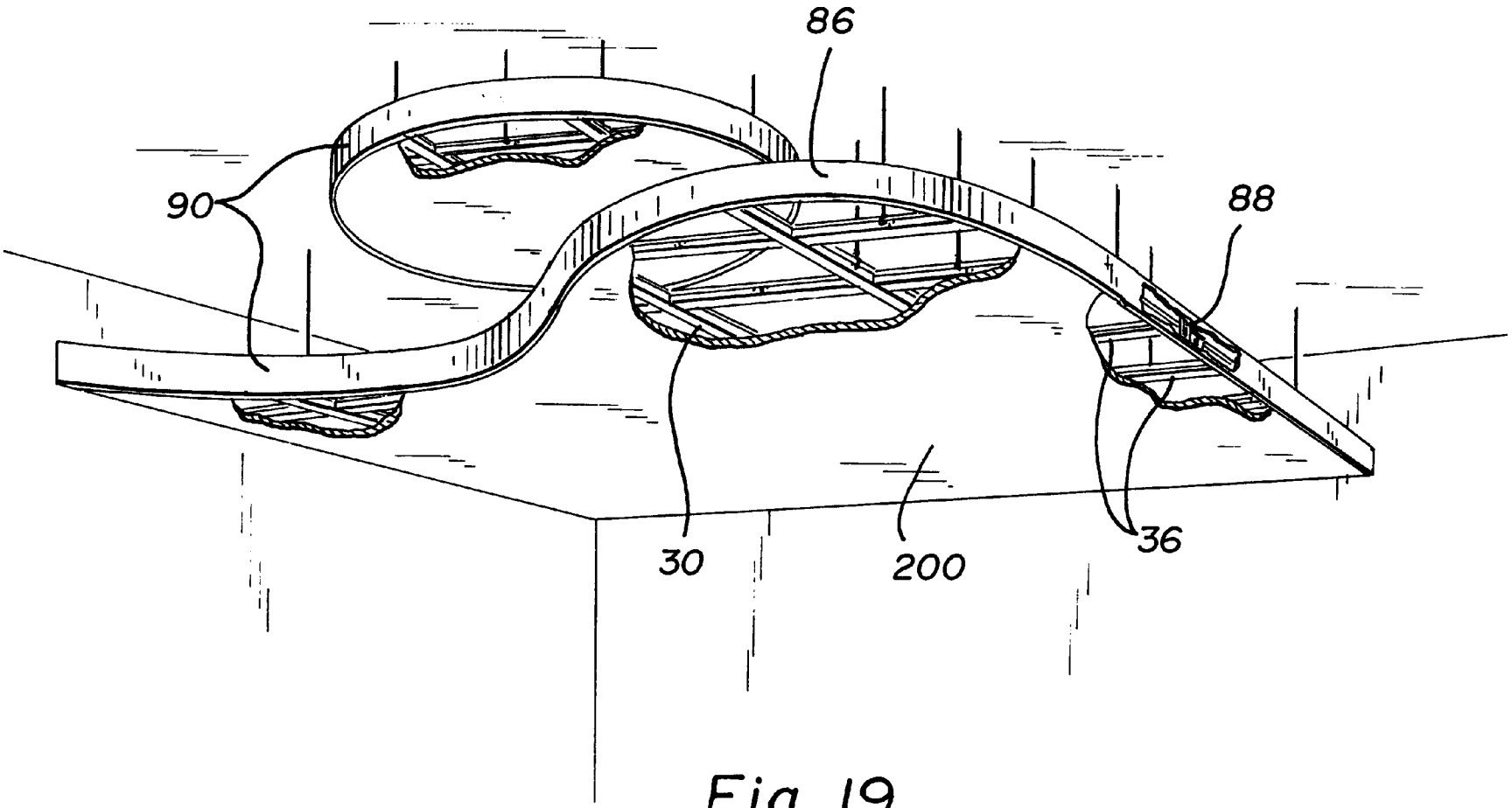
FIG. 19 is a perspective view of a flat suspended drywall ceiling showing a portion of the drywall cut away and exposing a drywall suspension grid having straight "T" grid beams and having portions with at least one beam end of each "T" grid beam forming a floating edge in the flat suspended drywall ceiling. Face trim is mounted to the beam ends and along the length of beams forming the floating edge, thereby forming a fascia having straight and serpentine portions.
Figure 20:
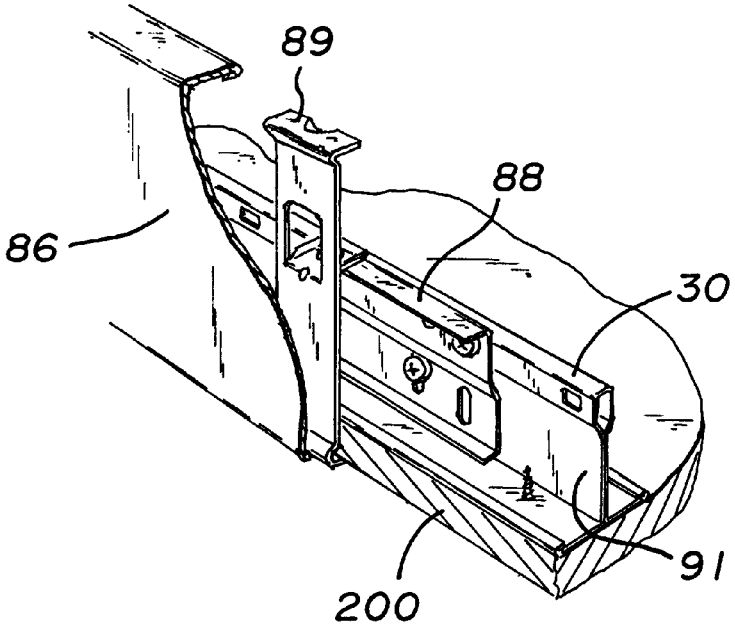
FIG. 20 is a detailed perspective view of a straight "T" grid beam and face trim positioned parallel to the "T" grid beam in the drywall suspension grid of FIG. 19. A face trim clip is mounted to the side of the "T" grid beam and the face trim is clipped to the face trim clip and positioned parallel to the "T" grid beam.

FIG. 19 shows a flat suspended drywall ceiling constructed from a drywall suspension grid having straight "T" grid main beams 30 and straight "T" grid cross beams 36 and having portions with at least one beam end of each straight "T" grid beams 30 and 36 forming a floating edge 90 having straight and serpentine portions in the flat suspended drywall ceiling. FIG. 20 shows a straight portion of the fascia created by a straight "T" grid main beam 30 running parallel to the floating edge 90. A straight "T" grid cross beam 36 (shown in FIG. 2) could also be used in place of the straight "T" grid main beam 30. A face trim clip 88 having a clip portion 89 is mounted to the web portion 91 of the straight "T" grid beam 30. Clip portion 89 is pivoted in a position parallel to the straight "T" grid beam 30 so that the face trim 86 can be clipped into place along the floating edge 90. The face trim clip 88 and its various installation configurations are the subject of pending U.S. patent application Ser. No. 09/025,272, filed on Feb. 18, 1998, herein incorporated by reference.

Figure 21:
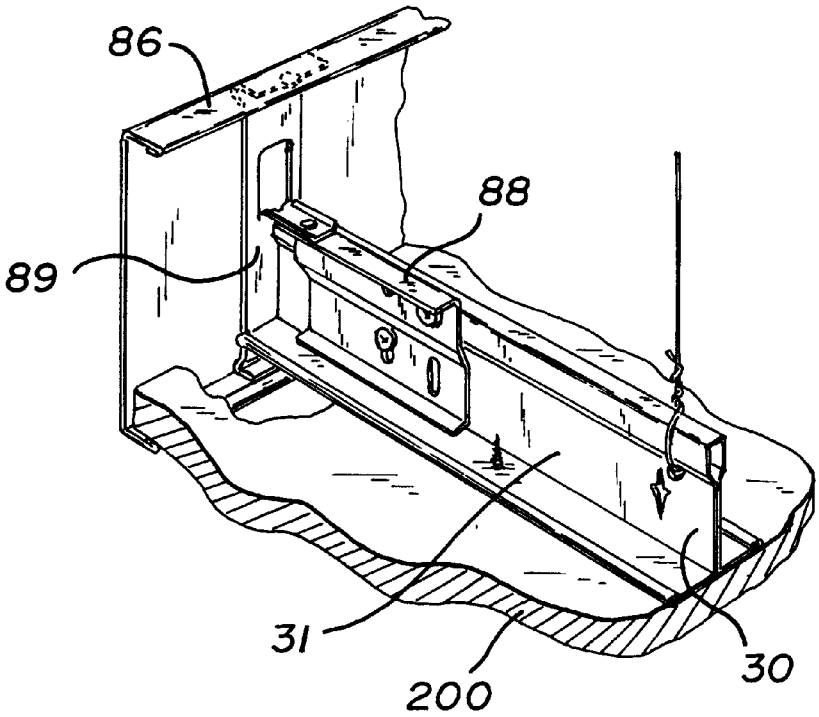
FIG. 21 is a detailed perspective view of the connection between a grid beam end and face trim positioned perpendicular to the grid beam end in the drywall suspension grid of FIG. 19. A face trim clip is mounted to the side of the "T" grid beam and the face trim is clipped to the face trim clip and positioned in transverse relation to the "T" grid beam.

FIG. 21 shows the transition point between a grid beam end of a straight "T" grid main beam 30 and face trim 86 positioned perpendicular to the grid beam end. A straight "T" grid cross beam 36 (shown in FIG. 2) could also be used in place of the straight "T" grid main beam 30. A face trim clip 88 having a clip portion 89 is mounted to the web portion 31 of the "T" grid beam 30 and the clip portion 89 is pivoted to allow the face trim 86 to be mounted to the face trim clip 88 in a transverse relation to the "T" grid beam 30. The pivoting of the clip portion 89 allows the grid beam end of the straight "T" grid beam 30 to intersect the floating edge 90 at any angle.

While specific embodiments of the present invention have been shown here for the purposes of explaining preferred and alternate embodiments of the invention, it is to be understood that the appended claims have a wide range of equivalents and a broader scope than the embodiments disclosed.

What is claimed is:

1. A drywall suspension system comprising:

a plurality of grid beams having top and bottom grid beam surfaces, said plurality of grid beams including curved grid beams having integrally continuous web portions disposed on said top grid beam surfaces along their length, said plurality of grid beams forming a multi-directional grid having a plurality of grid beam intersection points and transition points therein, the bottom grid beam surfaces of said plurality of grid beams providing a multi-directional grid surface;

a plurality of grid clips connected to the grid beams at the grid beam intersection points and transition points of the multi-directional grid; and drywall panels formed and shaped to match the multi-directional grid surface of the multi-directional grid, said drywall panels mounted onto the multi-directional grid surface.

2. The drywall suspension system of claim 1, wherein the multi-directional grid surface is planar.

3. The drywall suspension system of claim 1, wherein the multi-directional grid surface is curved.

4. The drywall suspension system of claim 3, wherein the curved multi-directional grid surface is convex.

5. The drywall suspension system of claim 3, wherein the curved multi-directional grid surface is concave.

6. The drywall suspension system of claim 3, wherein the curved multi-directional grid surface includes at least one convex portion and at least one concave portion.

7. The drywall suspension system of claim 1, wherein the multi-directional grid surface includes at least one planar portion and at least one curved portion.

8. The drywall suspension system of claim 7, wherein the curved portion is convex.

9. The drywall suspension system of claim 7, wherein the curved portion is concave.

10. The drywall suspension system of claim 7, wherein the curved portions include at least one convex portion and at least one concave portion.

11. The drywall suspension system of claim 1, wherein the multi-directional grid includes at least one soffit portion.

12. The drywall suspension system of claim 1, wherein the multi-directional grid has at least one floating edge.

13. The drywall suspension system of claim 1, wherein the plurality of grid clips includes at least one transition clip.

14. The drywall suspension system of claim 1, wherein the plurality of grid clips includes at least one splice clip.

15. The drywall suspension system of claim 1, wherein the plurality of grid clips includes at least one face trim clip.

16. The drywall suspension system of claim 1, wherein the drywall panels are mounted to the multi-directional grid surface with screws.

17. A drywall suspension system comprising:

a plurality of grid beams having top and bottom grid beam surfaces, said plurality of grid beams including curved grid beams having integrally continuous web portions disposed on said top grid beam surfaces along their length, said plurality of grid beams forming a multi-directional grid having a plurality of grid beam intersection points and transition points therein, the bottom grid beam surfaces of said plurality of grid beams providing a multi-directional grid surface;

a plurality of grid clips connected to the grid beams at the grid beam intersection points and transition points of the multi-directional grid; said grid beam transition points including points at which at least two grid beams are abutted together at one end of each grid beam and points at which at least one grid beam end perpendicularly meets at least one other grid beam along its length; said grid beam transition points further including points at which two grid beam ends meet at an angle; and drywall panels formed and shaped to match the multi-directional grid surface of the multi-directional grid, said drywall panels mounted onto the multi-directional grid surface.

18. The drywall suspension system of claim 17, the curved grid beams further having a fixed chord length and an arc angle of either 30, 45, 60, or 90 degrees.

19. The drywall suspension system of claim 17, wherein the grid beam surface of at least one of the curved grid beams is concave.

20. The drywall suspension system of claim 17, wherein the grid beam surface of at least one of the curved grid beams is convex.

21. The drywall suspension system of claim 17, wherein the drywall panels are mounted to the multi-directional grid surface with screws.

22. A drywall suspension system comprising:

a plurality of grid beams having grid beam surfaces, said plurality of grid beams including curved grid beams having integrally continuous web portions along their length, said plurality of grid beams forming a multi-directional grid having a plurality of grid beam intersection points and transition points therein, the grid beam surfaces of said plurality of grid beams providing a multi-directional grid surface;

a splice clip connected to two grid beams at one grid transition point of the multi-directional grid wherein said grid transition point is formed by at least two grid beams abutted together at one end of each grid beam;

a modified splice clip having two portions pivotally connected to each other, said splice clip connected to two grid beams at one grid transition point of the multi-directional grid wherein said grid transition point is formed by one end of the two grid beams meeting one end of the other of the two grid beams at an angle;

a transition clip connected to two grid beams at one grid transition point of the multi-directional grid wherein said grid transition point is formed by one end of the two grid beams meeting one end of the other of the two grid beams at a right angle;

a modified transition clip having two portions, one portion being transversely bent in relation to the other portion, said modified transition clip connected to two grid beams at one grid transition point of the multi-directional grid wherein said grid transition point is formed by one grid beam end perpendicularly meeting the other grid beam along its length;

a face trim clip including a pivotal clip portion, said face trim clip connected to one grid beam end and a face trim at one grid transition point wherein said grid transition point is formed by said grid beam end meeting the face trim along its length; and drywall panels formed and shaped to match the multi-directional grid surface of the multi-directional grid, said drywall panels mounted onto the multi-directional grid surface.

23. The drywall suspension system of claim 22, wherein the grid beam surface of at least one of the curved grid beams is concave.

24. The drywall suspension system of claim 22, wherein the grid beam surface of at least one of the curved grid beams is convex.

25. The drywall suspension system of claim 22, wherein the multi-directional grid surface includes at least one planar portion.

* * * * *